United States Patent [19]

Hüning et al.

[11] Patent Number: 4,915,617

[45] Date of Patent: Apr. 10, 1990

[54] DEVICE FOR FEEDING WASTE AIR AND/OR COMBUSTION AIR TO A BURNER OR COMBUSTION CHAMBER

[75] Inventors: Werner Hüning; Claus Gockel, both of Odenthal; Herbert Wiebe, Krefeld; Kurt Noll, Willich; Otto Carlowitz, Wolfenbuettel, all of Fed. Rep. of Germany

[73] Assignees: Bayer Aktiengesellschaft, Leverkusen; Kleinewefers Energie-Und Umwelttechnik GmbH, Krefeld, both of Fed. Rep. of Germany

[21] Appl. No.: 327,217

[22] Filed: Mar. 22, 1989

[30] Foreign Application Priority Data

Apr. 20, 1988 [DE] Fed. Rep. of Germany ..... 3813222

[51] Int. Cl.[4] ..... F23C 5/32

[52] U.S. Cl. ..... 431/173; 431/188; 110/264; 239/433

[58] Field of Search ..... 431/8, 9, 173, 182, 431/90; 110/263, 264, 265; 239/433, 493

[56] References Cited

U.S. PATENT DOCUMENTS

| | | | |
|---|---|---|---|
| 1,610,290 | 12/1926 | Jones et al. | 431/173 X |
| 2,023,696 | 12/1935 | Porteous | 431/173 |
| 3,200,870 | 8/1965 | Hanley et al. | 431/173 |
| 4,351,251 | 9/1982 | Brashears | 431/173 X |

FOREIGN PATENT DOCUMENTS 2925961 1/1981 Fed. Rep. of Germany .

*Primary Examiner*—Randall L. Green

*Attorney, Agent, or Firm*—Sprung Horn Kramer & Woods

[57] ABSTRACT

The device for feeding waste air and/or combustion air to a burner has an upstream cyclindrical swirl inlet system (inlet header 1) with feeder nozzles (8,9) leading in tangentially. The main nozzle (8) is here provided at a radial distance R from the burner axis on the inlet header (1), which distance is greater than the radius r of the combustion chamber (4). By means of this increase in the swirl radius, a substantially higher swirl intensity can be generated at small throughputs. In order to avoid an undue rise in the swirl at higher throughputs, a secondary flow (7), which is fed in via a control element (11), is introduced into the inlet header (1) via a secondary nozzle (9) tangentially and opposite to the main swirling flow. Alternatively, the secondary flow (7) can also be fed to the inlet header (1) via inlet slots (14) substantially at right angles to the direction of the main flow. In both cases, the tangential flow component of the main flow (6) is slowed down. The control element (11) in the secondary flow (7) is advantageously designed in such a way that the secondary flow (7) sets in only when the main flow throughput rises to 50% to 60% of the nominal throughput.

5 Claims, 3 Drawing Sheets

Figure 1:
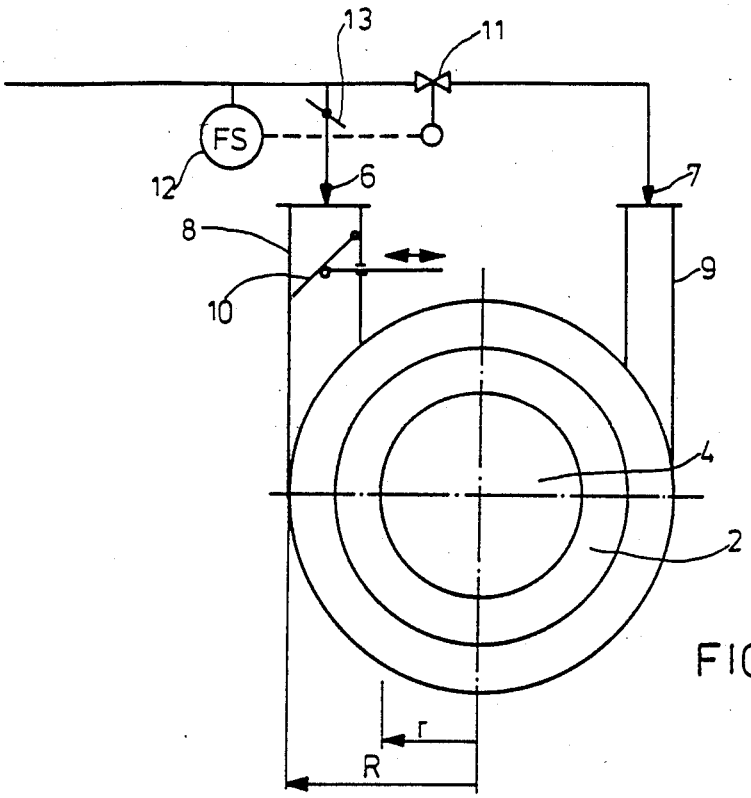

DEVICE FOR FEEDING WASTE AIR AND/OR COMBUSTION AIR TO A BURNER OR COMBUSTION CHAMBER

The invention starts from a device for feeding waste air and/or combustion air to a burner or combustion chamber via an upstream cylindrical inlet header with feeder nozzles leading tangentially into the inlet header to generate a swirling flow.

In swirl combustion chambers, preferably combustors, the combustion air and/or the gases to be burned are fed with an impressed rotary motion, that is to say under swirling conditions, so that a supercritical swirling flow field with a peripheral forward flow and an axial return flow forms in the combustion chamber. As a result of the thus extended flow travels of the gas molecules and the enhanced thorough mixing of the reaction partners, the collision probability of the reaction partners is substantially increased as compared with formerly usual burners, and a high output density is thus ensured.

In German Patent No. 2,925,961, a swirl burner is described which is fitted with swirl flaps for optimized adjustment of the combustion characteristics. The particular object here is that the swirl burner can be adapted to different mass flows and also different fuels and/ or gases to be burned. However, it has been found that, in particular whenever a wide mass or throughput control range is demanded from the burner or the combustion chamber, the swirl intensity necessary to achieve constant combustion results cannot be reached at small throughputs. The swirl flap provided according to the state of the art for swirl control had the effect, for example, that its corrective action ceased below a throughput rate of about 25% of nominal throughput or even led in the negative direction to a weakening of the swirl. The result of burning is then, under certain circumstances, an unstable flame which is divided into separate parts and partial flow-off of which would already lead to exit gas contamination in the sense of incomplete combustion. In unfavourable cases, disturbing vibrations which lead to a considerable noise nuisance can also occur at low throughputs.

It is this point with which the invention is concerned. It is based on the object of developing a swirl control or swirl regulation in combination with a combustion chamber or burner, which control in principle effects an increase in swirl at low throughputs and a weakening in swirl at large throughputs, in order to achieve optimum combustion results across a wide throughput range (1:10). The optimized swirl setting should here also be effective during the operation of a burner.

Starting from an inlet header with feeder nozzles leading in tangentially to produce a swirling flow, in conjunction with the burner or a combustion chamber, this object is achieved according to the invention when a main feeder nozzle is provided at a radial distance R from the burner axis on the inlet header, which distance is greater than the radius r of the combustion chamber, and when a secondary nozzle provided with a control element leads into the inlet header downstream of the main nozzle via an annular gap targentially and opposite to the main swirling flow, in such a way that the tangential flow component of the main flow is slowed down.

As a rule, the arrangement is designed in such a way that the secondary nozzle branches off from the main nozzle. For coarse adjustment of the swirl, a gate valve or a swirl flap is advantageously also provided in the main feeder nozzle.

According to a preferred embodiment of the invention, the control element in the secondary nozzle is opened by a mass flow sensor located in the main feeder nozzle only whenever the throughput rises to 40% to 80%, preferably 50% to 60%, of the nominal throughput. This means that a swirl component opposite to the main flow swirl, which effects a weakening of the swirl, is generated only at throughputs of >40% or >50%.

The central idea of the invention is thus that a substantially higher swirl intensity can be generated at small throughputs by increasing the swirl radius R and a weakening of the swirl (swirl braking) is effected at higher throughputs by the secondary flow entering in the opposite direction. Account is here taken of the fact that an unduly high swirl intensity unfavourably affects the combustion, and an increase in pressure drop, which has no effect on the combustion process, is avoided. Consequently, this is a fluid-dynamic swirl control or regulation.

In detail, the wide regulating and control range for the operation of the burner or combustion chamber, which can be achieved by the invention, has the following effects:

1. Optimized flame stabilization can be achieved and at the same time extinction of the flame is prevented,
   - 1.1 In the event of fast mass flow variations,
   - 1.2 In the event of fast load variations,
   - 1.3 In the event of fast oxygen concentration variations.
2. High combustion turbulence ($T_u$=0.3 to 0.4) can be accomplished. The results are:
   - 2.1 A high output density of the combustion; that is to say, at a given residence time, each fuel molecule has a chance of reaction which is greater by a factor of about 10.
   - 2.2 A good burn-up rate or a high quality of combustion, which is important especially in the combustion of chloro-aromatic compounds.
   - 2.3 Avoidance of local temperature peaks lasting for some time, which has a favourable effect with regards to the formation of $NO_x$.

In addition, the following advantages are achieved:

Based on the fluid-dynamic swirl control, the mixing intensity is adjustable within wide ranges.

Disturbing vibrations in single-burner or multi-burner systems can be avoided.

The fluid-dynamic swirl control allows certain degrees of freedom with respect to the selection of material in the design of the combustion chamber. The combustion chamber can be built either of metal or of ceramic.

Furthermore, because of the fluid-dynamic control, the pressure drop of the swirl burner is adjustable and controllable.

Figure 2:
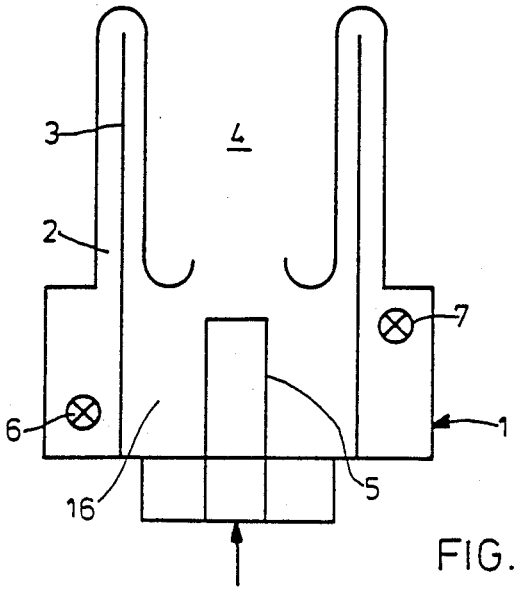
Figure 3:
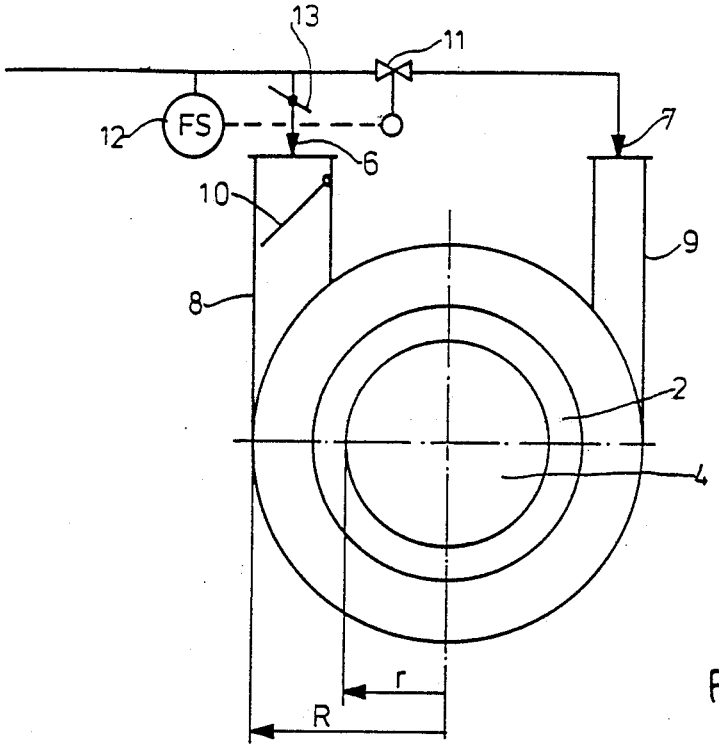
Figure 4:
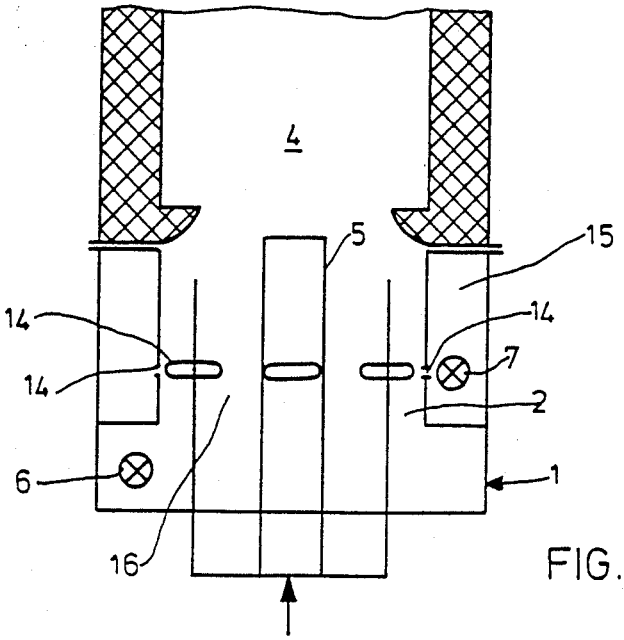
Figure 5:
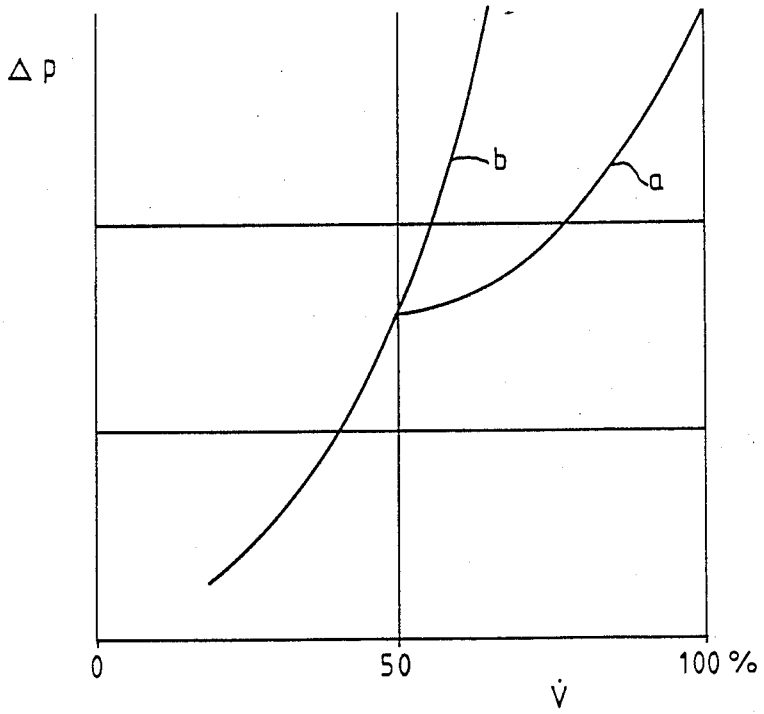

Illustrative examples of the invention are explained in more detail below by reference to drawings, in which FIG. 1 shows a swirl combustion chamber with tangential feeding of the secondary flow and fluid-dynamic control, in a cross-sectional representation, FIG. 2 shows the swirl combustion chamber according to FIG. 1 in plan view, FIG. 3 shows a swirl combustion chamber with peripheral feeding of the secondary flow and fluid-dynamic control, in a cross-sectional representation, FIG. 4 shows the combustion chamber according to FIG. 3 in plan view, and FIG. 5 shows the effectiveness of the fluid-dynamic swirl control by reference to the pressure drop of the system as a function of the throughput.

The swirl combustion chamber reproduced in the drawings is shown including the swirl inlet system or inlet header. It consists essentially of the inlet header 1 with an annular channel 2, to which the waste gases (waste air) to be burned are fed tangentially together with the combustion air required for this purpose. The gases are here deflected by 180° in the annular channel by means of a pipe 3 extending as a continuation of the inlet header 1 and are passed into a pre-chamber 16. The pre-chamber 16 is adjoined by the actual combustion chamber 4. The fuel is introduced axially into the combustion chamber 4 via a fuel device 5.

As shown in FIG. 1, the gas stream consisting of waste air and combustion air is divided into a primary flow 6 (main flow) and the secondary flow 7. The primary flow 6 and the secondary flow 7 are fed to the annular channel 2 via the main nozzles 8 and secondary nozzles 9, flanged on tangentially, and the inlet header 1. The secondary nozzle 9 leads into the inlet header 1 downstream of the main nozzle 8, as viewed in the direction of flow (see FIG. 2). A swirl component opposite to the primary flow is thus generated in the annular channel by the secondary flow 7; this means that the swirl intensity has been weakened after the recombination of primary flow and secondary flow. In other words, the opposite swirl component of the secondary flow 7 slows down the tangential flow component of the primary flow.

The enlargement of the swirl radius R is of constructional importance for the feeding of the primary flow: the primary flow 6 is fed via the main feeder nozzle 8 at a radial distance R from the burner axis, which distance is greater than the radius r of the combustion chamber 4. A substantially higher swirl intensity can again be generated in this way, as compared with conventional swirl inlet systems.

A swirl gate valve or swirl flap 10 for presetting, i.e. optimization, of the swirl intensity for the lower throughput range is located in the main nozzle 8. For coarse adjustment of the mass flow ratio of primary flow 6 and secondary flow 7, a restrictor flap 13 is used. A control element 11, for example an adjustable restrictor, which is controlled by a mass flow sensor 12 upstream of the division into primary flow and secondary flow, is located in the feedline for the secondary flow 7. This control or regulation will be described in more detail below.

An alternative embodiment of the swirl inlet system or swirl combustion chamber is shown in FIGS. 3 and 4. In contrast to the embodiment according to FIGS. 1 to 2, the secondary flow 7 is here recombined with the primary flow 6 via uniformly distributed inlet slots 14. The inlet slots 14 connect the annular gap 2 to the header 15, to which in turn the secondary nozzle 9 is flanged tangentially. As a result of the inlet slots 14, uniformly distributed around the periphery, the tangential flow component of the primary flow is weakened or slowed down. This arrangement allows a particularly uniform feeding of the secondary flow 7 and, as a consequence thereof, particularly good burn-up results to be achieved.

The effectiveness of the fluid-dynamic swirl control described can be seen from FIG. 5. In this diagram, the differential pressure $\alpha P$ between the waste air feedline, that is to say upstream of the diversion of the secondary flow and of the combustion chamber 4, is plotted as a function of the waste air throughput. The waste air throughput is here measured in the line upstream of the diversion of the secondary flow or in the main nozzle 8 (sensor 12). The control device 11, 12 is here designed in such a way that it responds only above a predetermined threshold value (50% of maximum throughput in this case). This means that the control element 11 is increasingly opened with rising throughput only above a predetermined throughput threshold, so that the secondary flow 7 increasingly gains influence and leads to a reduction in the resulting swirl. This behaviour corresponds to the right-hand branch a of the pressure curve. The left-hand branch b results when the control is switched off, that is to say without weakening of the swirl in the upper throughput range. It will be seen that the pressure drop with fluid-dynamic swirl control (curve a) is markedly reduced if compared with b (without swirl control). The threshold value for the onset of the swirl control, which is 50% in this case, is adjusted to a fixed setting, depending on the operating conditions, between 40% and 80%, preferably between 50% and 60%, of the nominal throughput.

We claim:

1. A burner having an inlet header, a cylindrical combustion chamber having an axis and a given radius and an upstream cylindrical swirl inlet system receptive of air for generating a swirling flow comprising a main feeder nozzle at a radial distance from the axis and on the inlet header to form a main swirling flow, which radial distance is greater than the given radius of the combustion chamber, means forming inlet slots in the header, a secondary nozzle with a control element leading into the inlet header downstream of the main nozzle through the inlet slots for forming a flow tangentially and opposite to the main swirling flow to slow down a tangential flow component of the flow from the main feeder nozzle.

2. The burner according to claim 1, wherein the secondary nozzle branch off from a common line.

3. The burner according to claim 1 or 2, further comprising an adjustable swirl flap or a swirl gate valve in the main nozzle.

4. The burner according to claim 3, wherein the control element includes a mass flow sensor located on the main nozzle for opening the control element when the throughput rises to 40% to 80% of the nominal throughput, such that a swirl component opposite to the main swirling flow is generated only at throughputs of >40%.

5. The burner according to claim 3, wherein the control element includes a mass flow sensor located on the main nozzle for opening the control element when the throughput rises to 50% to 60% of the nominal throughput, such that a swirl component opposite to the main swirling flow is generated only at throughputs of >50%.

* * * * *